US010587947B2

(12) United States Patent
Kelley et al.

(10) Patent No.: US 10,587,947 B2
(45) Date of Patent: Mar. 10, 2020

(54) EAR TIP WITH ANTI-TRAGUS STABILIZER

(71) Applicant: Plantronics, Inc., Santa Cruz, CA (US)

(72) Inventors: John A Kelley, Santa Cruz, CA (US); Jacob T Meyberg, Santa Cruz, CA (US); Matthew J Mainini, Santa Cruz, CA (US); Gary T Brint, Scotts Valley, CA (US)

(73) Assignee: Plantronics, Inc., Santa Cruz, CA (US)

( * ) Notice: Subject to any disclaimer, the term of this patent is extended or adjusted under 35 U.S.C. 154(b) by 18 days.

(21) Appl. No.: 15/438,595

(22) Filed: Feb. 21, 2017

(65) Prior Publication Data

US 2018/0242068 A1 Aug. 23, 2018

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.

CPC ..... *H04R 1/105* (2013.01); *H04R 1/1016* (2013.01); *H04R 1/1066* (2013.01); *H04R 5/0335* (2013.01)

(58) Field of Classification Search

CPC ..... H04R 1/105; H04R 1/1016; H04R 1/1066
USPC ..... 381/328, 380, 379, 322, 386
See application file for complete search history.

(56) References Cited

U.S. PATENT DOCUMENTS

| | | | | |
|---|---|---|---|---|
| 1,753,817 | A | 4/1930 | Aber | |
| 2,487,038 | A | 11/1949 | Baum | |
| 4,965,838 | A | 10/1990 | Kamon et al. | |
| 5,319,163 | A | 6/1994 | Scott | |
| 5,712,453 | A | 1/1998 | Bungardt et al. | |
| 6,810,987 | B1 | 11/2004 | DeKalb | |
| 7,986,803 | B1 | 7/2011 | DeKalb | |
| 8,625,834 | B2 * | 1/2014 | Smith | H04M 1/05 381/328 |
| 9,264,792 | B2 * | 2/2016 | Mainini | H04R 1/105 |
| 2008/0144877 | A1 | 6/2008 | Ham et al. | |
| 2013/0230204 | A1 | 9/2013 | Monahan et al. | |
| 2015/0078578 | A1 | 3/2015 | Silvestri et al. | |
| 2016/0066081 | A1 | 3/2016 | Annunziato et al. | |

FOREIGN PATENT DOCUMENTS

| | | | |
|---|---|---|---|
| WO | WO 2006/007541 | A1 | 1/2006 |
| WO | WO 2006/104981 | A2 | 10/2006 |

* cited by examiner

*Primary Examiner* — Phylesha Dabney

(74) *Attorney, Agent, or Firm* — Chuang Intellectual Property Law

(57) ABSTRACT

Methods and apparatuses for delivering sound to a user ear are disclosed. In one example, an apparatus for delivering sound to an ear canal includes a body attachable to an electro-acoustic transducer and an ear canal port attached to the body arranged to insert into an entrance of the user ear canal. The apparatus includes a suspension member attached to the body arranged to contact the cavum concha behind the antitragus and flexibly suspend an electro-acoustic transducer attached to the body above a floor area of the cavum concha. The suspension member is further arranged to flexibly suspend the electro-acoustic transducer attached to body adjacent a sidewall area of the cavum concha.

22 Claims, 7 Drawing Sheets

EAR TIP WITH ANTI-TRAGUS STABILIZER

BACKGROUND OF THE INVENTION

Various audio products exist in which an electro-acoustic transducer such as a speaker (also referred to herein as a receiver) is placed in the user's ear. For example, "in-the-ear" headsets or headphones, also referred to as ear bud or concha style headsets or headphones are devices for transmitting received sounds to the ear of the user by means of a small receiver which is sized to fit in the cavum concha in front of the ear canal. Conventional ear bud concha style headsets position the receiver inside the cavum concha between the tragus and anti-tragus to establish placement and support on the ear.

However, most audio products that are intended to be worn in the ear tend to be unstable or uncomfortable when worn. Different ear shapes and sizes make it difficult for a single design to fit the ear correctly, stabilize the headset, and be comfortable for the user. Minor size and shape variations of the concha of individual users results in instability for users whose concha do not hold the headset with sufficient force or discomfort to those with smaller concha. Without additional support, these devices can become loose (i.e., unstable) and audio quality is lost or degraded. Accordingly, the receiver is typically designed for a minimally sized concha and then held in place by an external mechanical stabilizer device such as a headband which arches over the top of the head or an ear hook which fits around the outside of the ear.

External mechanical stabilizer devices add complexity, which decreases ease of use and increases the cost of manufacturing. Some mechanical stabilizers can be difficult to operate or wear on the ear correctly due to an unintuitive or poor design, and require manual adjustment to position the receiver. Mechanical stabilizers also increase the size and weight of the headset, resulting in increased fatigue and discomfort from prolonged use. There are also more mechanical failures with added complexity.

Furthermore, such external mechanical stabilizers may not properly position the receiver in the ear, thereby allowing audio to "leak" out from the user's ear. This results in poor listening sound quality. The mechanical stabilizer may not ensure that the receiver stays in front of the ear canal, requiring the user to periodically readjust the stabilizer or receiver during usage to correct the placement.

As a result, there is a need for improved methods and apparatuses for wearing audio products.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1A:
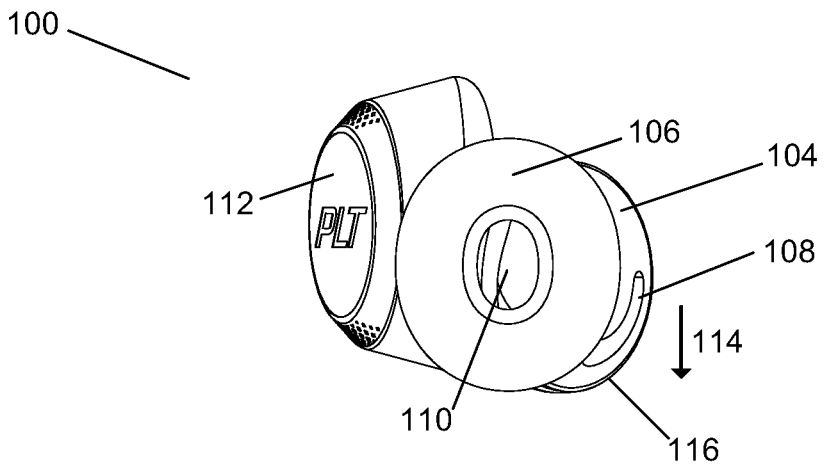
FIG. 1A illustrates a front view of an ear tip in an example of the invention.

Methods and apparatuses for delivering sound to a user's ear are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments.

Generally, this description describes a method and apparatus for an inventive ear tip (also referred to as an "eartip" or "earbud") having a stabilizer for use with an audio device such as a headset, stereo headphones, or stereo ear buds. The ear tip is conformable to the user's outer ear canal when inserted and provides an acoustic seal. The ear tip is self adjusting, and can be fitted to various ear cavum sizes for comfortable wearing and a secure fit. The present invention is applicable to any in-ear device designed to deliver sound to the ear canal. While the present invention is not necessarily limited to such devices, various aspects of the invention may be appreciated through a discussion of various examples using this context.

In one example, an apparatus for delivering sound to an ear canal includes a body comprising a surface to attach to an electro-acoustic transducer. The apparatus further includes a flexible and resilient suspension member dimensioned to fit within a cavum concha area of a user's ear. The suspension member is arranged to extend from the body to contact the cavum concha behind the antitragus and flexibly and resiliently suspend the body above a floor area of the cavum concha. The apparatus further includes an ear canal port attached to the body dimensioned to insert into an entrance of the user's ear canal.

In one example, the flexible and resilient suspension member is a disc shaped suspension member. In one example, the disc shaped suspension member includes an aperture arranged in proximity to a perimeter of the disc shaped suspension member. The aperture is arranged to allow compression of the perimeter of the disc shaped suspension member. In a further example, the flexible and resilient suspension member is oval shaped or rectangular shaped with rounded corners, where the member includes an open interior. In one example, a rounded corner of the rectangular shaped suspension member is arranged to contact the cavum concha behind the antitragus.

In one example, an apparatus for delivering sound to an ear canal includes a body attachable to an electro-acoustic transducer and an ear canal port attached to the body arranged to insert into an entrance of the user's ear canal. The apparatus includes a suspension member attached to the body arranged to contact the cavum concha behind the antitragus and flexibly suspend an electro-acoustic transducer attached to the body above a floor area of the cavum concha. The suspension member is further arranged to flexibly suspend the electro-acoustic transducer attached to body adjacent a sidewall area of the cavum concha.

In one example, an ear tip includes an anti-tragus stabilizer which is substantially oval or rectangular with rounded corners (referred to by the inventors as a "chain link" shape, "tail" or "stabilizer loop"). In one example, the stabilizer loop engages with the user's concha and provides force of ear tip into the ear canal. This improves fit, stability and insertion can be into the ear without needing to twist to fit properly. The stabilizer loop engages with both the cymba concha and behind the anti-tragus for stability, and the eartip stem and cone engages with the tragus in a spring-like manor for improved comfort. In certain examples, the stabilizer loop may have a curve to better fit into the ear and help "lock in" the ear tip, and have a cross member to better control flexing of the loop to best fit into the ear. In certain examples, the stabilizer loop may have a different durometer/hardness than a body portion to help balance comfort with stability and attachment strength.

The stabilizer loop provides several advantages. The stabilizer loop has no tips or points that can cause pressure points and discomfort and it provides stability to the ear tip for a consistent premium audio experience. The stabilizer loop is arranged to fit against the concha to provide force in the direction toward the ear canal to help ensure the ear tip remains stable in the ear-canal. Prior art apparatuses have a receiver body (either covered or uncovered) that contacts the ear (e.g., the tragus) as the ear tip is pushed into the ear canal. In one example, in the present design the receiver body does not directly contact the user's ear as the stabilizer loop suspends the receiver body proximate the user's ear. The stabilizer loop engages the anti-tragus to suspend the receiver and help keep the ear tip stable. Furthermore, the stabilizer loop can fit into the ear with a simple direct insertion direction rather than relying on a twist to ensure the anti-helix is used for the stability of the fit. Furthermore, the stabilizer tail flexes to conform to the shape of the user's concha, thus increasing surface friction with a distributed surface area contact for higher stability and higher comfort.

Figure 1B:
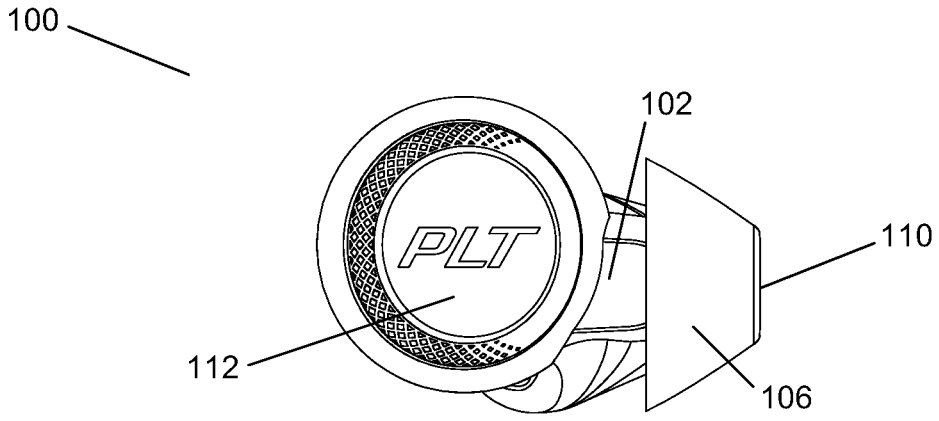
FIG. 1B illustrates a left side view of the ear tip shown in FIG. 1A.
Figure 1C:
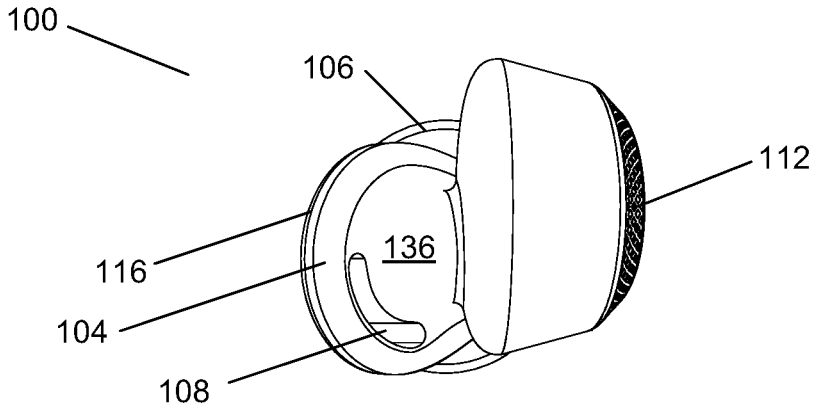
FIG. 1C illustrates a rear view of the ear tip shown in FIG. 1A.
Figure 1D:
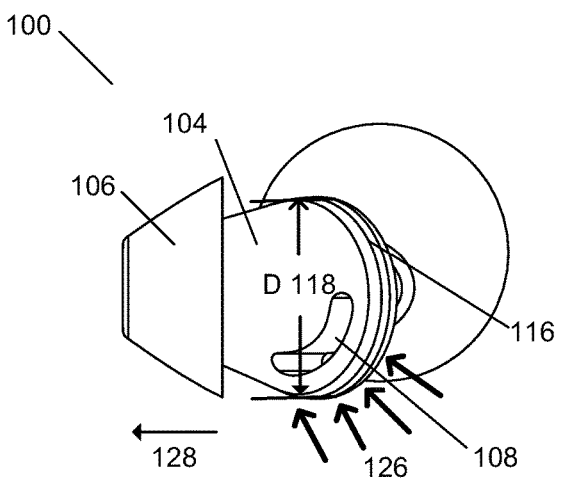
FIG. 1D illustrates a right side view of the ear tip shown in FIG. 1A.
Figure 1E:
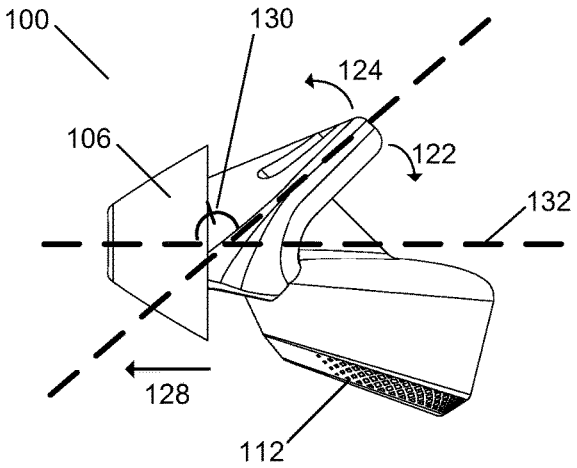
FIG. 1E illustrates a top view of the ear tip shown in FIG. 1A.
Figure 1F:
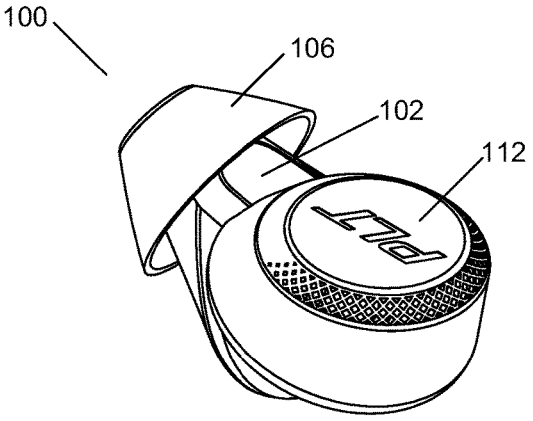
FIG. 1F illustrates a first perspective view of the ear tip shown in FIG. 1A.
Figure 1G:
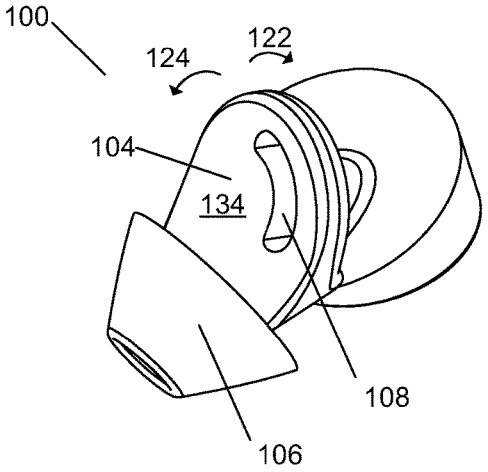
FIG. 1G illustrates a second perspective view of the ear tip shown in FIG. 1A.

FIG. 1A illustrates a front view of an ear interface apparatus 100 (referred to herein as an "ear tip") for delivering sound to an ear canal in an example of the invention. FIGS. 1B and 1C respectively illustrate a left side view and rear view of the ear tip 100. FIGS. 1D and 1E respectively illustrate a right side view and top view of the ear tip 100. FIGS. 1F and 1G respectively illustrate a first perspective view and a second perspective view of the ear tip 100.

Referring to FIGS. 1A-1G, the ear tip 100 includes a body 102 having a surface to attach to an electro-acoustic transducer 112. For example, the electro-acoustic transducer 112 is a speaker such as that used in a headset receiver, earphone, headphone, or stereo ear buds. The body 102 of ear tip 100 is arranged to attach to the electro-acoustic transducer 112. In one example, the ear tip 100 may attach to the electro-acoustic transducer 112 directly. Alternatively, a connector formed from a plastic, elastomer, or metal material may be assembled within the body 102. The connector may be constructed from a rigid plastic, elastomer, or metal material to which ear tip 100 is overmolded. In one mode of operation, the connector is designed to interlock with an associated connector at the electro-acoustic transducer for either left or right ear wearing. The ear tip 100 delivers audio and secures and stabilizes the electro-acoustic transducer 112 as described herein.

The ear tip 100 includes a flexible and resilient suspension member 104 dimensioned to fit within a cavum concha area of a user's ear. The suspension member 104 is arranged to extend from the body 102 to contact the cavum concha behind the antitragus and flexibly and resiliently suspend the body 102 above a floor area of the cavum concha. Ear tip 100 includes an ear canal port 106 attached to the body 102 dimensioned to insert into an entrance of the user's ear canal. In one example, the ear canal port 106 includes a conical structure providing an acoustic seal when inserted into the user's ear. Body 102 includes an acoustic channel 110 between the electro-acoustic transducer 112 and the ear canal port 106, where the acoustic channel 110 is arranged to transmit sound output from the electro-acoustic transducer 112 to the user's ear through the ear canal port 106. In one example, body 102 and suspension member 104 are partially or fully integrated as a single structure.

Referring to FIG. 1D, flexible and resilient suspension member 104 is arranged to apply an inward force in a direction 128 to the ear canal port 106 towards the user's ear canal when inserted. Flexible and resilient suspension member 104 is further arranged with respect to the ear canal port 106 to limit an insertion depth of the ear canal port 106 into the user's ear canal.

In this example, at least a portion of the flexible and resilient suspension member 104 is disc shaped. The disc shaped suspension member 104 includes an aperture 108 arranged in proximity to a perimeter 116 of the disc shaped suspension member 104, the aperture 108 allowing compression of the perimeter 116 when ear tip 100 is first inserted in the user's ear or responsive to a force applied in direction 126 by the cavum floor if suspension member 104 is pulled downward in direction 114. Aperture 108 is crescent shaped to match the perimeter 116. The size of aperture 108 may be tuned as desired by the manufacturer to optimize a desired balance between comfort/flexibility and stability. Aperture 108 allows suspension member 104 to flex and relieve pressure on the bottom perimeter 116 of the disc.

Still referring to FIG. 1D, the disc shaped suspension member 104 has a diameter 118 sized to fit within a cavum concha such that the circumferential perimeter 116 surface contacts beneath a crus helix and the circumferential perimeter 116 surface contacts a floor area of the cavum concha when inserted in the user's ear. The flexible and resilient suspension member 104 is arranged with respect to the ear canal port 106 to position the ear canal port 106 at a desired height above a floor area of the cavum concha proximate the entrance to the user's ear canal.

Disc shaped suspension member 104 includes a first planar surface 134 (FIG. 1G) flexible and resilient inwards to contact a sidewall area of the cavum concha and a second planar surface 136 (FIG. 1C) and flexible outwards to contact an inner surface of the antitragus. In one example, planar surface 134 is sufficiently flexible to conform to the sidewall of the cavum concha to a certain extent. Disc shaped suspension member 104 is arranged at an angle 130 (FIG. 1E) with respect to an axis 132 through a center of the ear canal port 106 towards the user's ear canal. In one example, the angle 130 between the ear canal port 106 and the disc shaped suspension member 104 is an obtuse angle. In one example operation, angle 130 operates to apply an inward force in a direction 128 to the ear canal port 106 towards the user's ear canal when inserted and limit an insertion depth of the ear canal port 106 into a user's ear canal.

As previously described, ear tip 100 may be formed from a first material and a second material having different hardness levels in one example. For example, the body 102 has at least a portion formed from a material having a higher hardness level than suspension member 104. For example, body 102 is formed from a material having a hardness of approximately 60-90 shore-A durometers and suspension member 104 is formed from an elastomer material having a hardness of approximately 20-40 shore-A durometers. Body 102 advantageously has a greater hardness at surfaces mating with the electro-acoustic transducer 112 so that it can be attached to the electro-acoustic transducer 112 in a secure manner (i.e., it does not tear or unintentionally decouple or spin about the transducer). Suspension member 104 advantageously has a lower hardness so that it can flex and compress as desired to more easily conform to the user's ear to provide a sufficient friction to hold and suspend the electro-acoustic transducer 112 in place. The lower hardness of suspension member 104 further promotes comfort to the user. In one example, the flexible and resilient suspension member 104 is formed from a material having a same durometer hardness as the ear canal port 106. In a further example, at least a portion of the flexible and resilient suspension member 104 is formed from a material having a different hardness than a material of the ear canal port 106, which may have a lower hardness to maximize comfort when inserted into the sensitive ear canal.

In operation, the flexible and resilient suspension member 104 is resiliently compressible downward in a direction 114 (FIG. 1A) towards the floor area of the cavum concha. The flexible and resilient suspension member 104 is resiliently flexible inwards in a direction 124 towards the user's ear canal to flexibly contact the surface of the cavum concha. The flexible and resilient suspension member 104 is further resiliently flexible outwards in a direction 122 away from the user's ear canal against an inner surface of the antitragus (FIGS. 1E and 1G).

In one example implementation, ear canal port 106 is attached to the body 102 and arranged to insert into an entrance of the user's ear canal. Suspension member 104 is arranged to contact the cavum concha behind the antitragus and flexibly suspend an electro-acoustic transducer 112 attached to the body 102 above a floor area of the cavum concha. The suspension member 104 is further arranged to flexibly suspend the electro-acoustic transducer 112 attached to body 102 adjacent a sidewall area of the cavum concha. Suspension member 104 is resiliently compressible in an inward direction towards the user's ear canal responsive to an applied inward force to the electro-acoustic transducer 112. Suspension member 104 is resiliently compressible in a downward direction towards the floor area of the cavum concha responsive to an applied downward force to the electro-acoustic transducer 112. Suspension member 104 is resiliently flexible in an outward direction away from the user's ear canal responsive to an applied outward force to the electro-acoustic transducer 112, wherein the suspension member 104 flexes against an inner surface of the antitragus. Due to its limited range of flexibility, suspension member 104 operates to limit an insertion depth of the ear canal port 106 into a user's ear canal if the user attempts to insert ear canal port 106 too deep.

In one example, the body 102, the flexible suspension member 104, and ear canal port 106 are composed of one or more of a soft, elastic or elastomeric material. In one example, the material selected is non-porous. For example, ear tip 100 may be constructed from a compressible, conformable, and resilient material. Suitable materials include elastomers, rubbers, foam, and air-filled injection molded materials. The elastomer may be sponge-like, filled with air pockets to enhance compressibility. The body 102 may also be hollow. Ear tip 100 may be fabricated by a variety of conventional methods including casting, overmolding, compression molding, and injection molding.

Figure 2:
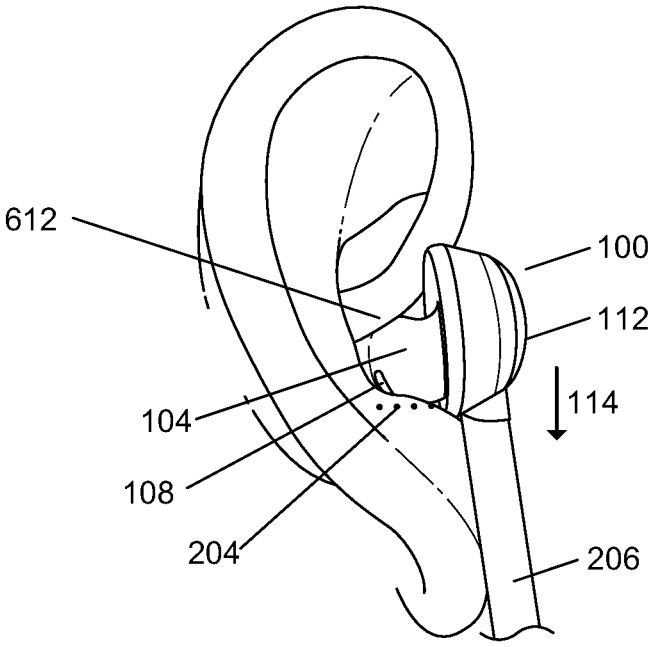
FIG. 2 illustrates the ear tip shown in FIG. 1A inserted within a human ear in one example.
Figure 6:
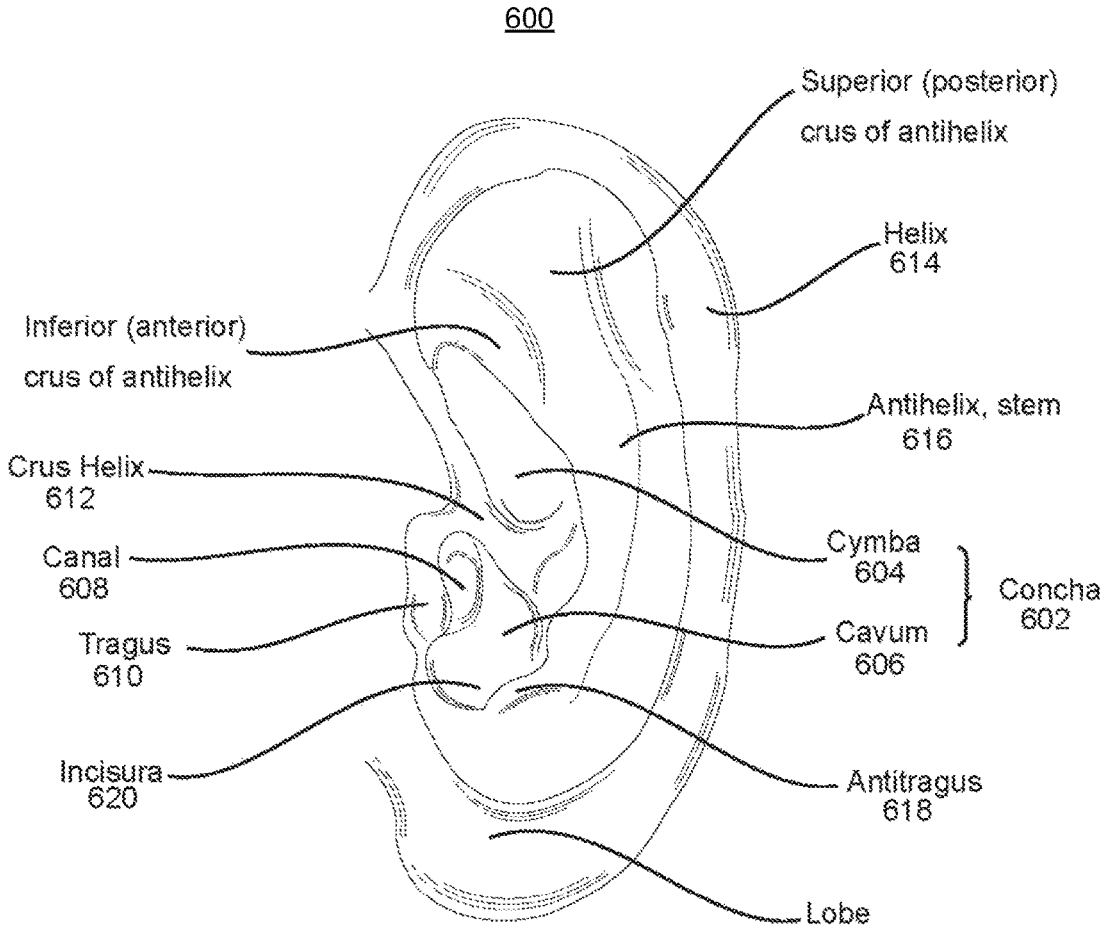
FIG. 6 illustrates a human ear.

FIG. 2 illustrates an ear tip 100 in one example of the present invention inserted within a right human ear. Referring to FIG. 2 and FIG. 6 together, in operation, the user pushes ear canal port 106 and suspension member 104 into the cavum concha 606 where it rests in the user's ear. The disc shaped suspension member 104 has a diameter 118 sized to fit within a cavum concha such that a circumferential perimeter 116 surface contacts beneath a crus helix 612 and the circumferential perimeter 116 surface contacts a floor area 204 of the cavum concha when inserted in the user's ear.

The suspension member 104 is arranged to extend from the body 102 to contact the cavum concha behind the antitragus and flexibly and resiliently suspend the body 102 above the floor area 204 of the cavum concha. In operation, the flexible and resilient suspension member 104 is advantageously resiliently compressible downward in a direction 114 towards the floor area 204 of the cavum concha.

The disc shaped suspension member 104 includes an aperture 108 arranged in proximity to a perimeter 116 of the disc shaped suspension member 104, the aperture 108 arranged to allow this compression of the perimeter 116 of the disc shaped suspension member 104. Suspension member 104 maintains the electro-acoustic transducer in a suspended position (also referred to by the inventors as "floating") flexible in multiple directions with respect to the user's ear: downwards to the cavum concha floor area via aperture 108, inward towards the ear canal and sidewall area of the cavum concha, and outwards towards the inner surface of the antitragus. This multi-directional flexibility ensures proper placement of the ear canal port for delivery of sound, eliminates the need for frequent readjustment, eliminates the need for upper concha engagement (for low impact activities), and provides stability and comfort when the electroacoustic transducer 112 is inadvertently pulled or pushed either directly or via a wire cable 206 (e.g., in downward direction 114).

Advantageously, the floating design prevents the ear tip 100 from being easily pulled out of the ear inadvertently because there is flexibility (i.e., give) in the position. Furthermore, where the electroacoustic transducer 112 includes one or more user interfaces requiring touch input, the multi-directional flexibility provides stability and comfort as the user interacts with the user interface. Advantageously, ear tip 100 is easily and consistently donned and doffed while simultaneously providing for stability and comfort.

Disc shaped suspension member 104 applies an inward force to ear canal port 106 to provide an acoustic seal, thereby enhancing low frequency response. Disc shaped suspension member 104 keeps ear canal port 106 in the proper sealed position even if cable 206 is pulled downward in direction 114.

Because the shape of the cavum concha 606 is neither circular nor symmetrical from left to right ears, in one example, aperture 108 is advantageously utilized to provide a custom fit and long term wearing comfort, allowing the suspension member 104 to deform and adapt to the shape of the cavum concha 106, and thereby maintain the electro-acoustic transducer 112 firmly in position. In one example operation, perimeter 116 is compressed into aperture 108 when a user inserts suspension member 104 into the user's ear and upon release after insertion, the suspension member 104 expands to fill the cavum concha 606, conforming to the individual user's cavum concha 606 to provide optimal stability and acoustic coupling.

In one example, several sizes of ear tips (e.g., small, medium, and large sized diameter disc shaped suspension members 104) may be selected from to provide a more personalized fit. These sizes may be determined by testing and evaluating multiple sizes of ear tips on test participants until the proper sizes are determined to provide the optimal fit for the respective ear shapes and sizes. For example, the disc shaped suspension member 104 has a diameter 118 of approximately 12 mm to 15 mm. For each sized diameter disc, the suspension member 104 can be further tuned by adjusting the size of aperture 108, allowing for a greater size of ears to be accommodated for each diameter disc. For example, a larger diameter disc with a larger aperture can fit an ear size similar to a smaller diameter disc with a smaller aperture, as the larger aperture provides a greater ability to flex.

Advantageously, the user will benefit from wearing the inventive ear tip over the prior art ear tip designs. The inventive ear tip improves both comfort and stability by utilizing the suspension/floating design as described herein. The comfort gains allow the user to wear in-ear audio products for longer periods of time. This translates to positive user experiences and longer wearing for telecommunications applications or music/entertainment listening.

Figure 3A:
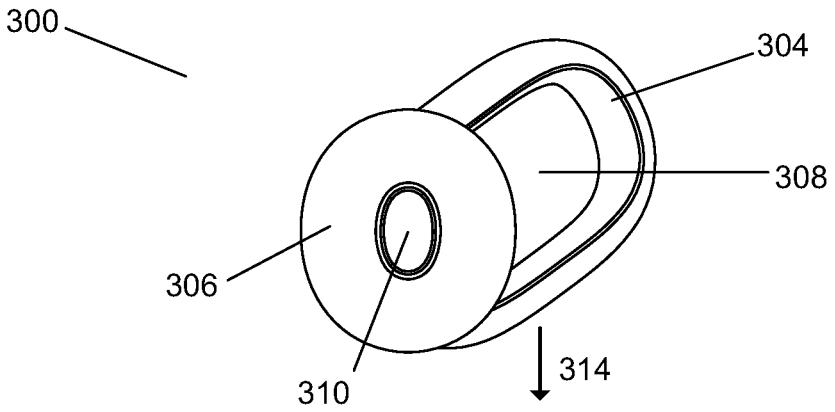
FIG. 3A illustrates a front view of an ear tip in an example of the invention.
Figure 3B:
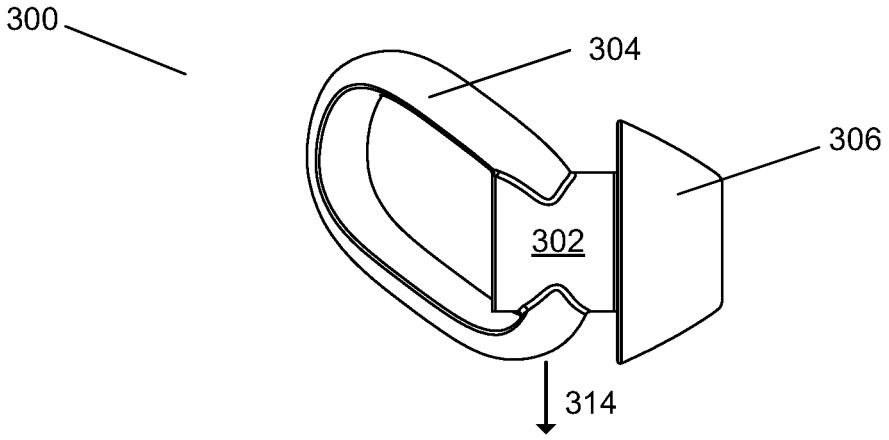
FIG. 3B illustrates a left side view of the ear tip shown in FIG. 3A.
Figure 3C:
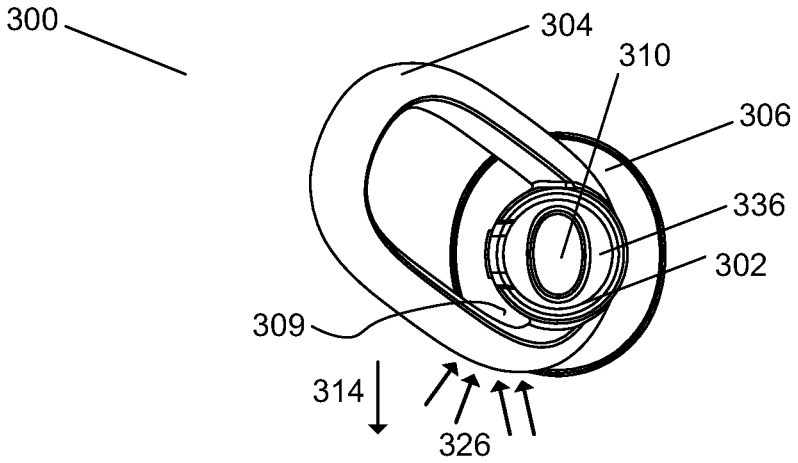
FIG. 3C illustrates a rear view of the ear tip shown in FIG. 3A.
Figure 3D:
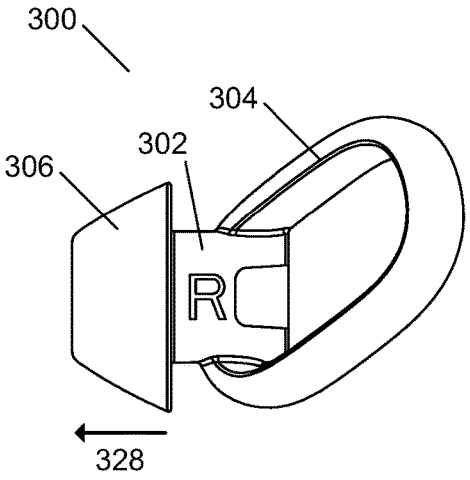
FIG. 3D illustrates a right side view of the ear tip shown in FIG. 3A.
Figure 3E:
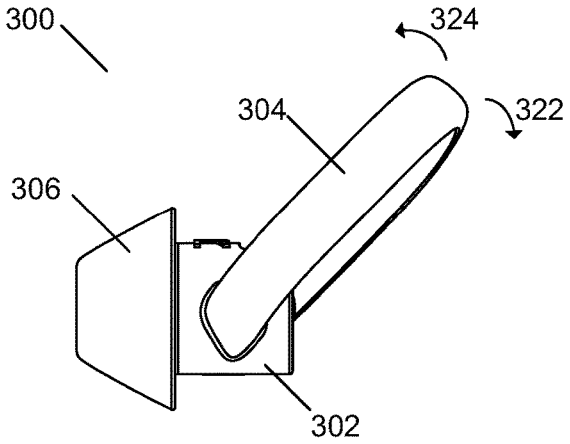
FIG. 3E illustrates a top view of the ear tip shown in FIG. 3A.
Figure 3F:
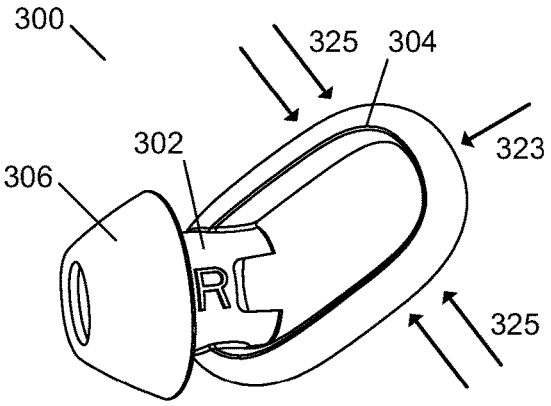
FIG. 3F illustrates a first perspective view of the ear tip shown in FIG. 3A.
Figure 3G:
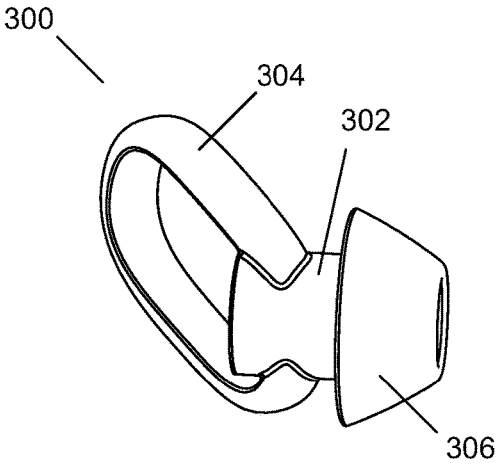
FIG. 3G illustrates a second perspective view of the ear tip shown in FIG. 3A.

FIG. 3A illustrates a front view of an ear tip 300 for delivering sound to an ear canal in a further example of the invention. FIGS. 3B and 3C respectively illustrate a left side view and rear view of the ear tip 300. FIGS. 3D and 3E respectively illustrate a right side view and top view of the ear tip 300. FIGS. 3F and 3G respectively illustrate a first perspective view and a second perspective view of the ear tip 300.

Referring to FIGS. 3A-3G, the ear tip 300 includes a body 302 attachable to an electro-acoustic transducer. The ear tip 300 further includes a flexible and resilient suspension member 304 dimensioned to fit within a cavum concha and cymba concha area of a user's ear. In this example, the flexible and resilient suspension member 304 is rectangular shaped with rounded corners and an open interior 308. A rounded corner of the rectangular shaped suspension member 304 is arranged to contact the cavum concha behind the antitragus. Hereinafter, the flexible and resilient suspension member 304 may also be described synonymously as oval shaped with an open interior.

The suspension member 304 is arranged to extend from the body 302 to contact the cavum concha behind the antitragus and flexibly and resiliently suspend the body 302 above a floor area of the cavum concha. The ear tip 300 further includes an ear canal port 306 attached to the body 302 dimensioned to insert into an entrance of the user's ear canal. In one example, the ear canal port 306 includes a conical structure which seals to the exterior of the ear canal opening. In one example, ear canal port 306 provides shallow occlusion of the ear canal opening as opposed to penetrating deep in the ear canal. Body 302 includes an acoustic channel 310 between the electro-acoustic transducer and the ear canal port 306, the acoustic channel arranged to transmit sound from the electro-acoustic transducer to the user's ear through the ear canal port 306.

The suspension member 304 has a length and width sized to fit within a user's ear such that a perimeter 316 surface contacts a cymba concha area (e.g., beneath the antihelix) and the circumferential perimeter 316 surface contacts a floor area of the cavum concha when inserted in the user's ear. The flexible and resilient suspension member 304 is arranged with respect to the ear canal port 306 to position the ear canal port 306 at a desired height above a floor area of the cavum concha proximate the entrance to the user's ear canal. In one example, suspension member 304 fills the space of the rear concha area when inserted.

Referring to FIG. 3C, the flexible and resilient suspension member 304 is resiliently compressible downward in a direction 314 towards the floor area of the cavum concha. In response to compression in a downward direction 314, the floor area of the cavum concha applies force in an opposing direction 326, thereby deforming (i.e., compressing) the perimeter 316 of suspension member 304 into open area 309 of open interior 308. Referring to FIG. 3E, the flexible and resilient suspension member 304 is resiliently flexible inwards in a direction 324 towards the user's ear canal to flexibly contact the surface of both the cavum concha and cymba concha. The flexible and resilient suspension member 304 is further resiliently flexible outwards in a direction 322 away from the user's ear canal against an inner surface of the antitragus. In one example, suspension member 304 engaging the anti-tragus allows sufficient insertion of ear canal port 306 into the user's ear canal to obtain good low frequency response, but limits possible over insertion which would result in discomfort. In this manner, a comfortable light seal at the front of the ear canal is enabled.

The oval shaped suspension member 304 is deformable and compressible in any direction to fit and conform as needed within a user's ear between a floor area of the cavum concha beneath the antitragus and a cymba concha area beneath the antihelix when inserted in the user's ear. For example, the oval shaped suspension member 304 is compressible and deformable to form a substantially circle shaped suspension member 304 if compressed in a direction 323 (FIG. 3F). A flex in one direction results in an increase in size in another direction. Ear tip 300 provides for enhanced stability while still providing for stability and comfort.

Advantageously, the flexibility of suspension member 304 in multiple directions allows for positioning and conforming of the suspension member 304 to specific user ears, providing enhanced stability of an electro-acoustic transducer. In one example, the overall length of the suspension member 304 is approximately 22 mm-25 mm and the width is 14 mm-16 mm. In one example, at least a portion of the suspension member 304 is formed from a material having a different hardness than a body 302 material.

In certain examples, depending upon user preference and/or the variable size and shape of the user's ear, the positioning of suspension member 304 within the user's ear may vary to achieve an optimal fit for a particular user. For example, suspension member 304 may be positioned at different locations within the concha, specifically the cavum and cymba area. The suspension member 304 will distribute the electro-acoustic transducer load along the surface of the cavum and/or cymba, depending on positioning. The surface friction combined with the specific pressure that forces the ear canal port 306 towards the ear canal achieves the desired stability while maintaining high comfort. In one example usage, the cymba is not required to be engaged as the anti-tragus contributes to preventing the eartip from dislodging.

Figure 4:
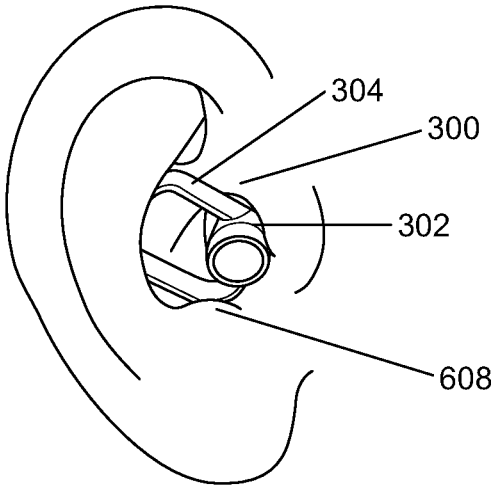
FIG. 4 illustrates the ear tip shown in FIG. 3A inserted within a human ear in one example.
Figure 5:
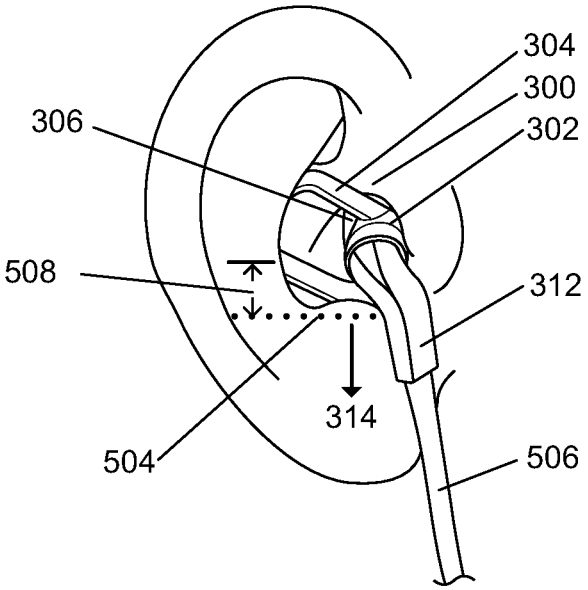
FIG. 5 illustrates the ear tip shown in FIG. 3A attached to an electro-acoustic transducer inserted within a human ear in one example of the present invention.

FIG. 4 illustrates the ear tip 300 shown in FIG. 3A inserted within a human ear in one example of the present invention. FIG. 5 illustrates the ear tip shown in FIG. 3A attached to an electro-acoustic transducer 312 inserted within a human ear in one example of the present invention. Referring to FIGS. 4, 5, and 6 together, in operation, the user pushes ear canal port 306 and suspension member 304 into the user's ear. The suspension member 304 has a length and width sized to fit within a user's ear such that a perimeter 316 surface contacts the cymba concha 604 and the circumferential perimeter 316 surface contacts a floor area 504 of the cavum concha 606 when inserted in the user's ear.

The suspension member 304 is arranged to extend from the body 302 to contact the cavum concha behind the antitragus and flexibly and resiliently suspend the body 302 a height 508 above floor area 504 of the cavum concha. In operation, the flexible and resilient suspension member 304 is advantageously resiliently compressible downward in a direction 314 towards the floor area 204 of the cavum concha. In this manner, body 302 and the electro-acoustic transducer 312 are prevented from direct contact with the user's cavum, preventing uncomfortable pressure when ear tip 300 is inserted or if force is applied in direction 314.

In one example, suspension member 304 engages the cymba concha 604 below the antihelix 616, thereby providing improved stability. Suspension member 304 is elongated and flexible and automatically adjusts and conforms to the size and shape of the cymba concha 604 and cavum concha 606 while providing sufficient force to hold the electro-acoustic transducer suspended above the floor of the cavum concha 606, ensuring proper placement and eliminating the need for frequent readjustment.

In certain examples, depending upon user preference and/or the variable size and shape of the user's ear, the positioning of suspension member 304 within the user's ear may vary to achieve an optimal fit for a particular user. In one example, suspension member 304 compresses as needed when it is placed in the concha 602, depending on the specific size and shape of the user's ear. Upon release, suspension member 304 expands to fill the cavum concha 606 and cymba concha 604, conforming to the individual user's cavum concha 606 and cymba concha 604 to provide optimal acoustic coupling and stability. Because the shape of the concha 602 is neither circular nor symmetrical from left to right ears, an oval shape made of a soft, resilient and malleable material is advantageously selected for self-adapting fit and long term wearing comfort. Suspension member 304 deforms and adapts to the shape of the concha, thereby maintaining the electro-acoustic transducer 312 firmly in position. In one example, several sizes of ear tips may be selected from to provide a more personalized fit.

In operation, a pair of ear tips 300 (i.e., a right ear tip and a left ear tip) may each serve as one part of a clasp mechanism to securely attach to one another. Advantageously, where a wire cable 506 is utilized for each ear bud, a user may remove the ear tips and wear the headset in a necklace form factor by clasping the right and left ear tips together. For example, the ear tips may interlock using either of two methods. In a first mode of operation, the flexible and resilient suspension member 304 of a right ear tip is attached to the body 302 of a left ear tip (or vice versa) by sliding/pushing the cone shaped ear canal port 306 of the left ear tip through the open interior 308 of the right ear tip. The suspension member 304 may deform as necessary to create the necessary width to slide over cone shaped ear canal port 306, and then resiliently return to its original oval shape when released. Upon release, the cone shaped ear canal port 306 of the left ear tip operates to prevent right ear tip suspension member 304 from sliding off the body 302 of the left ear tip.

In a second mode of operation, the flexible and resilient suspension member 304 of a right ear tip is compressed in an inward direction 325 (FIG. 3F), thereby decreasing its width, and inserted into the open interior 308 of the left ear tip at approximately a 90 degree angle such that the right suspension member 304 and left suspension member are crossed. Upon release, the right suspension member 304 resiliently forms a friction bond with the interior surface of the left suspension member when it is prevented from attempting to return to its full original (i.e., non-compressed) width by the interior width of the left suspension member. Using either mode of operation, there is advantageously no need for heavy magnets or extra male/female parts to allow for secure out-of-ear headset wearing on the user body.

FIG. 6 illustrates a human ear 600. The outer ear, or pinna, is an irregularly concave cartilaginous member comprised of a number of eminences and depressions which give each ear a distinct shape and form. The helix 614 is the curved outer rim of the ear; below the helix 614 is the anti-helix 616, a curved prominence which describes a curve around the concha 602, a deep cavity containing the entry to the ear canal 608. The concha 602 is divided into two parts, the cymba concha 604 and cavum concha 606, by the crus helix 614 which curves around the outside of the ear, and extends inwards at about the vertical midpoint of the ear. The cymba concha 604 lies above the crus helix 614 and below the anti-helix 616; the cavum concha 606 lies below the crus helix 614 and surrounds the entry to the ear canal 608. In front of the cavum concha 606 and projecting backwards from the front of the ear is the tragus 610, a small semicircular prominence. Opposite the tragus 610 and separated from it by the deep curvature of the incisura 620 is the antitragus 618.

The various examples described above are provided by way of illustration only and should not be construed to limit the invention. The ear tip can be used with any headset for personal listening to any audio source device. For example, the invention can be used with headsets or headphones/stereo ear buds typically employed for listening to music or video entertainment. The invention can be used with any concha style headset receiver coupled to any audio source.

Based on the above discussion and illustrations, those skilled in the art will readily recognize that various modifications and changes may be made to the present invention without strictly following the exemplary embodiments and applications illustrated and described herein. Such changes may include, but are not necessarily limited to: size of the ear tip and associated sections, material of the ear tip, and mating mechanism with an audio device receiver. Furthermore, the shapes and sizes of the illustrated transducer housing and components may be altered. Such modifications and changes do not depart from the true spirit and scope of the present invention that is set forth in the following claims.

Thus, the scope of the invention is intended to be defined only in terms of the following claims as may be amended, with each claim being expressly incorporated into this Description of Specific Embodiments as an embodiment of the invention.

What is claimed is:

1. An apparatus for delivering sound to an ear canal comprising:

a body comprising a surface to attach to an electro-acoustic transducer;

a flexible and resilient suspension member dimensioned to fit within a concha of a user ear, the suspension member arranged to extend from the body to contact the cavum concha behind an antitragus and flexibly and resiliently suspend the body above and without contact with a floor area of the cavum concha, wherein the flexible and resilient suspension member is a rectangular shaped suspension member comprising rounded corners and an open interior, wherein a rounded corner of the rectangular shaped suspension member is arranged to contact the floor area of the cavum concha behind the antitragus; and an ear canal port attached to the body dimensioned to insert into an entrance of a user ear canal.

2. The apparatus of claim 1, wherein the flexible and resilient suspension member is resiliently compressible downward towards the floor area of the cavum concha.

3. The apparatus of claim 1, wherein the flexible and resilient suspension member is resiliently compressible inwards towards the user ear canal to flexibly contact the surface of the cavum concha.

4. The apparatus of claim 1, wherein the flexible and resilient suspension member is resiliently flexible outwards away from the user ear canal.

5. The apparatus of claim 1, wherein the flexible and resilient suspension member is arranged to flex against an inner surface of the antitragus.

6. The apparatus of claim 1, wherein the flexible and resilient suspension member is arranged to apply an inward force to the ear canal port towards the user ear canal when inserted.

7. The apparatus of claim 1, wherein the ear canal port comprises a conical structure.

8. The apparatus of claim 1, wherein the flexible and resilient suspension member is further arranged to contact a cymba concha area of the user ear.

9. The apparatus of claim 1, wherein the flexible and resilient suspension member is arranged with respect to the ear canal port to limit an insertion depth of the ear canal port into a user ear canal.

10. The apparatus of claim 1, wherein the flexible and resilient suspension member is arranged with respect to the ear canal port to position the ear canal port at a desired height proximate a user ear canal.

11. The apparatus of claim 1, wherein at least a portion of the flexible and resilient suspension member is formed from a material having a different hardness than a material of the body.

12. The apparatus of claim 1, wherein the electro-acoustic transducer comprises a speaker.

13. The apparatus of claim 1, wherein the body comprises an acoustic channel between the surface to attach to the electro-acoustic transducer and the ear canal port, the acoustic channel arranged to transmit sound from the electro-acoustic transducer to the user ear through the ear canal port.

14. The apparatus of claim 1, wherein the rectangular shaped suspension member is deformable and compressible in any direction to fit within the user ear between the floor area of the cavum concha beneath the antitragus and a cymba concha area beneath an antihelix when inserted in the user ear.

15. An apparatus for delivering sound to an ear canal comprising:

a body comprising a surface to attach to an electro-acoustic transducer;

a flexible and resilient suspension member dimensioned to fit within a cavum concha of a user ear, the suspension member arranged to extend from the body to contact a floor area of the cavum concha behind an antitragus and flexibly and resiliently suspend the body above and without contact with the floor area of the cavum concha, wherein the flexible and resilient suspension member is a disc shaped suspension member; and an ear canal port attached to the body dimensioned to insert into an entrance of a user ear canal.

16. The apparatus of claim 15, wherein the disc shaped suspension member comprises an aperture arranged in proximity to a perimeter of the disc shaped suspension member, the aperture arranged to allow compression of the perimeter of the disc shaped suspension member.

17. The apparatus of claim 15, wherein the disc shaped suspension member has a diameter sized to fit within a cavum concha such that a circumferential perimeter surface contacts beneath a crus helix and the circumferential perimeter surface contacts the floor area of the cavum concha when inserted in the user ear.

18. The apparatus of claim 15, wherein the disc shaped suspension member is arranged at an angle with respect to an axis through a center of the ear canal port towards the user ear canal.

19. An apparatus for delivering sound to an ear canal comprising:

a body attachable to an electro-acoustic transducer;

an ear canal port attached to the body arranged to insert into an entrance of a user ear canal; and a suspension member attached to the body arranged to contact a cavum concha behind an antitragus and flexibly suspend an electro-acoustic transducer attached to the body above a floor area of a cavum concha, wherein the body is without contact with the floor area of the cavum concha, the suspension member further arranged to flexibly suspend the electro-acoustic transducer attached to the body adjacent a sidewall area of the cavum concha, wherein the suspension member is a rectangular shaped suspension member comprising rounded corners and an open interior, wherein a rounded corner of the rectangular shaped suspension member is arranged to contact the floor area of the cavum concha behind the antitragus.

20. The apparatus of claim 19, wherein the suspension member is resiliently compressible in an inward direction towards the user ear canal responsive to an applied inward force to the electro-acoustic transducer.

21. The apparatus of claim 19, wherein the suspension member is resiliently compressible in a downward direction towards the floor area of the cavum concha responsive to an applied downward force to the electro-acoustic transducer.

22. The apparatus of claim 19, wherein the suspension member is resiliently flexible in an outward direction away from the user's ear canal responsive to an applied outward force to the electro-acoustic transducer, wherein the suspension member flexes against an inner surface of the antitragus.

* * * * *